US008474774B2

(12) United States Patent
Svensson

(10) Patent No.: US 8,474,774 B2
(45) Date of Patent: Jul. 2, 2013

(54) PANEL COMPONENT HOLDER

(75) Inventor: Sven Svensson, Furulund (SE)

(73) Assignee: Axis AB, Lund (SE)

( * ) Notice: Subject to any disclaimer, the term of this patent is extended or adjusted under 35 U.S.C. 154(b) by 468 days.

(21) Appl. No.: 12/243,312

(22) Filed: Oct. 1, 2008

(65) Prior Publication Data

US 2009/0091941 A1 Apr. 9, 2009

Related U.S. Application Data

(60) Provisional application No. 60/977,449, filed on Oct. 4, 2007.

(30) Foreign Application Priority Data

Oct. 2, 2007 (EP) ..... 07117700

(51) Int. Cl.
*B42F 13/00* (2006.01)

(52) U.S. Cl.
USPC ..... 248/343; 362/365

(58) Field of Classification Search
USPC ..... 248/318, 224.7, 314, 343, 603, 222.11, 248/230.7; 362/453, 147, 364, 365, 366, 362/370, 371
See application file for complete search history.

(56) References Cited

U.S. PATENT DOCUMENTS

| | | | | |
|---|---|---|---|---|
| 3,620,401 | A | 11/1971 | Lund | |
| 4,733,339 | A * | 3/1988 | Kelsall | 362/366 |
| 4,739,460 | A | 4/1988 | Kelsall | |
| 4,760,510 | A | 7/1988 | Lahti | |
| 4,763,231 | A * | 8/1988 | Houplain | 362/148 |
| 5,077,650 | A * | 12/1991 | Cestari | 362/365 |
| 5,377,088 | A * | 12/1994 | Lecluze | 362/366 |
| 5,818,437 | A | 10/1998 | Grover et al. | |
| 6,016,596 | A | 1/2000 | Rodgers | |
| 6,132,069 | A * | 10/2000 | Sato et al. | 362/365 |
| 6,174,076 | B1 | 1/2001 | Petrakis et al. | |
| 6,234,691 | B1 | 5/2001 | Jones et al. | |
| 6,554,458 | B1 | 4/2003 | Benghozi | |
| 6,752,520 | B2 | 6/2004 | Vernusset et al. | |
| 6,896,394 | B2 | 5/2005 | Houle | |
| 6,992,723 | B1 | 1/2006 | Wulf et al. | |
| 7,155,683 | B1 | 12/2006 | Williams | |
| 7,217,008 | B2 * | 5/2007 | Thompson et al. | 362/285 |
| D655,035 | S * | 2/2012 | Wu | D26/152 |
| 2003/0223240 | A1 * | 12/2003 | Houle | 362/364 |
| 2006/0197748 | A1 | 9/2006 | Hatch | |

FOREIGN PATENT DOCUMENTS

| | | | |
|---|---|---|---|
| DE | 9304635 | U1 | 6/1994 |
| DE | 102004055781 | A1 | 6/2006 |
| DE | 102005028781 | A1 | 12/2006 |

(Continued)

*Primary Examiner* — Terrell McKinnon
*Assistant Examiner* — Eret McNichols
(74) *Attorney, Agent, or Firm* — Volpe and Koenig, P.C.

(57) ABSTRACT

The invention relates to a panel component holder arranged to be attached to a panel element. The panel component holder comprises at least one supporting means and a casing including a brim and at least one retainer. The at least one supporting means comprises an attached end being attached to the casing, an elastic means and a free end. Said at least one retainer is arranged to prevent outwardly movement of the at least one supporting means from said casing in a plane coinciding with the centre axis of the casing, wherein the outwardly movement of the supporting means is induced by the elastic means.

14 Claims, 6 Drawing Sheets

FOREIGN PATENT DOCUMENTS

| | | | |
|---|---|---|---|
| EP | 0840060 | A2 | 10/1997 |
| EP | 1028285 | A1 | 8/2000 |
| EP | 1106917 | A2 | 11/2000 |
| EP | 1577611 | A2 | 9/2005 |
| FR | 2638817 | A1 | 5/1990 |
| GB | 2309513 | A | 7/1997 |
| JP | 4108274 | | 4/1992 |
| JP | 09129025 | A | 5/1997 |
| WO | 2006012524 | A2 | 2/2006 |
| WO | 2007032030 | A1 | 3/2007 |

* cited by examiner

PANEL COMPONENT HOLDER

TECHNICAL FIELD OF THE INVENTION

The present invention relates to a panel component holder.

BACKGROUND OF THE INVENTION

Panel components, such as spotlights, are mounted to panel elements. Panel elements can for example be panels for walls or for suspended ceilings and be of various materials such as wood fibre, aluminium, glass fibre, gypsum.

When mounting panel components several difficulties may occur. The panel element is for example easily damaged during installation of the panel component since the panel component is usually fixedly attached to the panel element. Panel elements of different thicknesses constitute a challenge since the panel components are usually adapted to fit only a certain panel thickness. Various panel element materials can also be a problem since the mounting means has to be implemented in different ways depending on the material of the panel element. Furthermore, the installation is troublesome and difficult since one usually has to fiddle in the space that is formed between the panel component and the panel element in order to fasten the panel component and sometimes even usage of a tool is necessary in order to mount the panel component.

U.S. Pat. No. 6,752,520 B2 describes a lighting apparatus comprising a fixing support having a collar, a locking lug and a vertical element. The locking lug can be moved from a locked position into an unlocked position. The lighting apparatus has a rod that can release the locking lug from its locked position, a zone for abutment and guidance of the locking lug, and a spring that can exert a pressure on the locking lug when the latter is in an unlocked position such that the lug, guided by the abutment and guidance area and by the vertical element, exerts a pressure on a false ceiling. When the fixing support is installed, the false ceiling is held between the locking lug and the collar.

Major drawbacks of this technique are the time and effort necessary to prepare the lighting apparatus and put it in the locked position. The installation itself is also enormously tedious and unnecessarily complicated. Furthermore, the construction of the lightning apparatus is extremely complicated.

SUMMARY OF THE INVENTION

The object of the invention is to facilitate mounting of panel components to panel elements.

The above object is achieved according to a first aspect of the invention by means of a panel component holder comprising a casing including a brim and at least one retainer. The panel component holder further comprises at least one supporting means comprising an attached end being attached to the casing, the at least one supporting means further comprising an elastic means and a free end. The at least one retainer is arranged to prevent outwardly movement of the at least one supporting means from the casing in a plane coinciding with the centre axis of the casing, wherein the outwardly movement of the at least one supporting means is induced by the elastic means.

This embodiment is advantageous in that the panel component holder is easily mounted, without any special tools, to panel elements of different thicknesses and materials. The panel component holder may further be installed without damaging the panel element and the panel component may be demounted.

A further advantage is that during transportation and prior to installation of the panel component holder, the retainer retaining of the supporting means may slim the profile of the panel component holder which hence reduces space costs.

According to another embodiment, the elastic means is a torsion spring. The use of a torsion spring is advantageous in that it is both cost efficient and provides a relatively large force.

According to yet another embodiment, the elastic means is arranged at the attached end, which simplifies the attaching of the supporting means to the panel component holder.

According to another embodiment, the at least one supporting means further comprises a flexible section arranged between the attached end and the free end. The flexible section simplifies the releasing of the supporting means from the retainer.

According to another embodiment, the at least one supporting means further comprises at least one leg.

According to another embodiment, the at least one supporting means further comprises at least one bend arranged between the attached end and the free end. The at least one bend may simplify the releasing of the supporting means from the retainer in that it makes the supporting means easier to reach from the inside of the casing. The at least one bend may alternatively be advantageous in that it provides a section to abut against the inner side of the panel element almost regardless of the inclination of the supporting means.

According to another embodiment, the at least one supporting means further comprises at least one protrusion arranged at the free end or between the free end and the attached end. The at least one protrusion may simplify the attaching of the supporting means to the retainer.

According to another embodiment, the casing further comprises a first, open end, a second end, and a casing wall arranged between the first, open end and the second end and wherein the at least one retainer is arranged as at least one slot at the second end.

According to another embodiment, the casing further comprises a first, open end, a second end, and a casing wall arranged between the first open end and the second end and wherein the casing wall comprises at least one control opening for enabling control of the supporting means. The control opening is advantageous in that the supporting means can be controlled from the inside of the casing, through the control opening, hence providing possibility for the person installing the panel component holder to use only one hand when controlling the supporting means. Furthermore, there is no need to demount the panel from the ceiling in order to install the panel component holder.

According to another embodiment, the at least one control opening is partly arranged in the casing wall and partly in the second end which simplifies the control of the supporting means.

According to a further embodiment, the at least one retainer is formed by an edge of the at least one control opening.

According to another embodiment, the at least one retainer, described in the further embodiment in the paragraph above, is formed as a protrusion.

According to another embodiment the at least one retainer, described in the further embodiment in the paragraph above, is formed as a slot.

According to another embodiment, an opening is arranged substantially centrally in the second end. This is advantageous in that the opening provides simple access for cables into the panel component holder.

The above object is also achieved according to a second aspect of the invention by means of a method for attaching a panel component holder to a panel element, the panel component holder comprising a casing including a brim and at least one retainer. The panel component holder further comprises at least one supporting means comprising an attached end being attached to the casing, the at least one supporting means further comprising an elastic means and a free end.

The method comprises inserting the panel component holder through an opening in the panel element, abutting the brim against the panel element, and releasing said at least one supporting means from the at least one retainer, wherein the at least one supporting means describes an outwardly movement from said casing in a plane coinciding with the centre axis of the casing induced by the elastic means.

The advantages of the first aspect are also applicable to the second aspect. Moreover, by means of this method the mounting of the panel component holder may be facilitated.

According to another embodiment, the releasing of the at least one supporting means further comprises releasing the at least one supporting means from the inside of the casing. This is advantageous in that the releasing may be performed with only one hand, in that there is no need to demount the panel element in order to mount the panel component holder and in that one does not have to fiddle in the space that is formed between the panel component holder and the panel element.

According to another embodiment, the releasing of the at least one supporting means further comprises moving a portion of the at least one supporting means out of reach for the at least one retainer.

A further scope of applicability of the present invention will become apparent from the detailed description given below. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other features and advantages of the present invention will become apparent from the following detailed description of a presently preferred embodiment, with reference to the accompanying drawings, in which.

DETAILED DESCRIPTION OF AN EMBODIMENT

Figure 1:
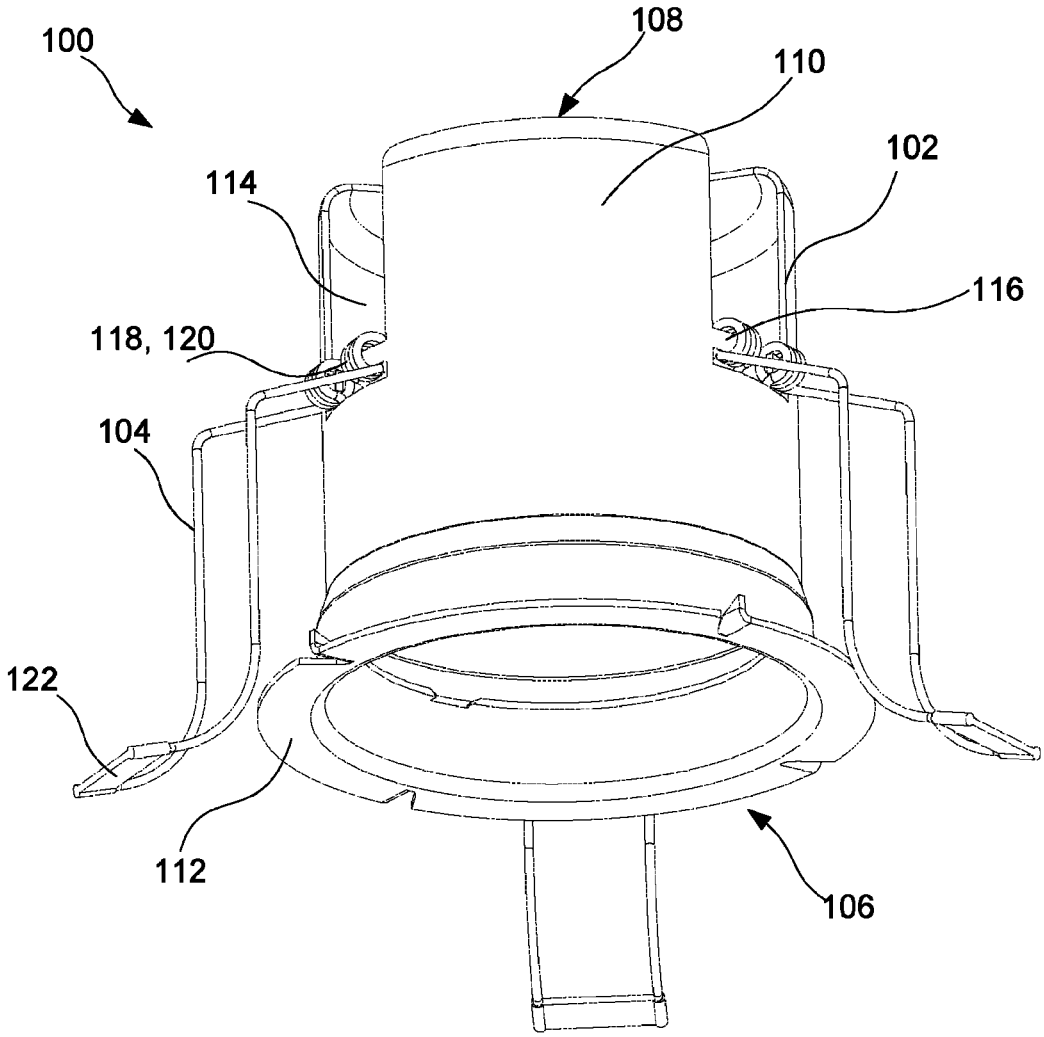
FIG. 1 is a perspective view of one embodiment of a panel component holder according to the present invention.

FIG. 1 illustrates a panel component holder 100 arranged to receive a panel component such as for example a camera, a spotlight, a loudspeaker, a fire detector, a movement detector, a gas detector or the like. The panel component holder includes a casing 102 and at least one supporting means 104. The supporting means 104 has a free end 122, an elastic means 118, and an attached end 120. The elastic means 118 may be arranged at the attached end 120. The attached end 120 of the supporting means 104 is attached to the casing 102.

The casing 102 may further have one open end 106, which is normally used for insertion of panel components, and a second end 108, the ends 106, 108 being connected by a casing wall 110. The first, open end 106 has a circumferential brim 112 which is perpendicular to the casing wall 110.

The panel component holder 100 is secured to a panel element by the supporting means 104 on the inner side of the panel element and by the circumferential brim 112 on the outer side of the panel element.

The panel component holder 100 comprises at least one retainer (not shown in the Figure) arranged to interact with the at least one supporting means 104 by preventing outwardly movement of the supporting means 104 from the casing 102 in a plane coinciding with the centre of the axis of the casing 102, wherein the outwardly movement of the supporting means 104 is induced by the elastic means 118.

In one embodiment of the invention, such as in FIG. 1, the casing 102 may be of cylindrical shape. However other embodiments of the casing 102 may be differently shaped.

The casing 102 may further comprise at least one control opening 114 enabling control of the supporting means 104. In the embodiment of FIG. 1, the at least one control opening 114 is partly arranged in the casing wall 110 and partly in a part of the second end 108. Alternatively, in another embodiment, the at least one control opening 114 may be arranged only in the casing wall 110 or only in a part of the second end 108, respectively.

In a first embodiment, the supporting means 104 is realized as a supporting plate. The supporting plate may be entirely solid or comprise at least one section that is not solid. The section not being solid may for example comprise at least one elongated member. The section not being solid may be made of a flexible, elastic material. Furthermore, the solid part of the supporting plate may be partly made of a flexible material, for example rubber.

In a second embodiment, the supporting means 104 is realized as a supporting leg. The supporting leg may comprise one or more elongated members. The supporting leg may further have different shapes, such as for example L-shape.

The supporting means 104 may have at least one flexible section. The section being flexible implies that it is resilient, elastic and springing. The flexible section may for example be solid and made of a flexible and elastic material, for example rubber. Alternatively, the flexible section may for example be arranged as at least one elongated member.

Figure 2A:
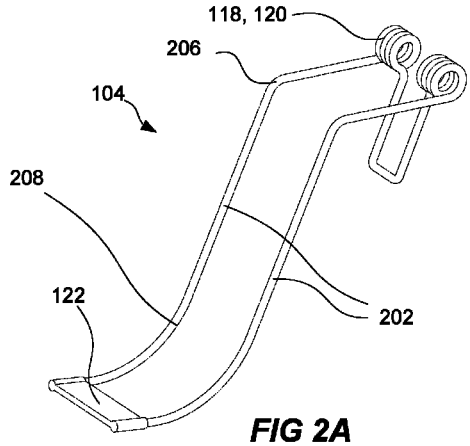
FIG. 2A is a perspective view of one embodiment of a supporting means of the panel component holder according to the present invention.

FIG. 2A shows the supporting means 104 according to the second embodiment. The supporting means 104 may for example be made of some sort of metal. The supporting leg is realized as two elongated members 202 being attached to the attached end 120, in this case an elastic means 118, and to the free end 122.

Figure 2B:
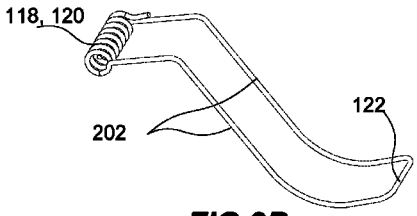
FIG. 2B is a perspective view of another embodiment of a supporting means of the panel component holder according to the present invention.
Figure 2C:
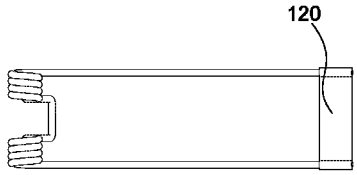
FIG. 2C is a top view of the supporting means of FIG. 2A.
Figure 2D:
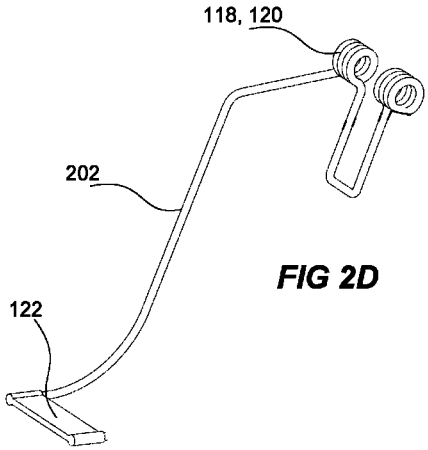
FIG. 2D is a perspective view of another embodiment of a supporting means of the panel component holder according to the present invention.

The elastic means 118 may be realized as for example a spring, such as a torsion or blade spring, or another elastic means obvious to a person skilled in the art. The elastic means of FIG. 2A is a pair of torsion springs. FIG. 2B shows the supporting means 104 according to the second embodiment but with the elastic means 118 realized as one torsion spring. FIG. 2D shows the supporting means 104 according to the second embodiment and with the supporting means 104 having one elongated member 202. The free end 122 may for example be realized as a plate as shown in FIGS. 2A, 2C, and 2D, wherein FIG. 2C is a top view of the supporting means of FIG. 2A. The free end 122 may alternatively be realized as an elongation of the one or more elongated members protruding from the one or more elongated members or as in FIG. 2B as an elongation of the two elongated members 202 connecting the two elongated members 202.

In one embodiment, the supporting means 104 may have a first and a second bend 206, 208. The first and second bends 206, 208 are arranged somewhere between the attached end 120 and the free end 122. The at least one flexible section may be arranged at the first bend 206. The first bend 206 simplifies the releasing of the supporting means 104 from the retainer in that it makes the supporting means 104 easier to reach from the inside of the casing 102.

The supporting means 104 has an inclination adaptable to the panel element thickness. This requires the part of the supporting means arranged to abut against the panel element to adjust to the inclination of the supporting means 104. It is the second bend 208 that is adapted to abut against the inner side of the panel element to which the panel component holder 100 is to be attached to. The second bend 208 provides a section to abut against the panel element almost regardless of the inclination of the supporting means 104.

The supporting means 104 may be attached at the attached end 120 to the casing 102 in various ways. One way of attaching the supporting means 104 is shown in FIG. 1 and will be described, as follows. A first end of the at least one control opening 114, the first end being closer to the first, open end 106, has a tooth 116 on each side of the at least one control opening 114 protruding from the edge of the at least one control opening 114 towards an opposite side of the at least one control opening 114. The attached end 120 in FIG. 1 is an elastic means, more specifically a pair of torsion springs. When the torsion springs are attached to the casing 102, the teeth 116 protrude through the centre of the torsion springs. Further ways of attaching the supporting means 104 to the casing 102 are obvious to a person skilled in the art.

Figure 3A:
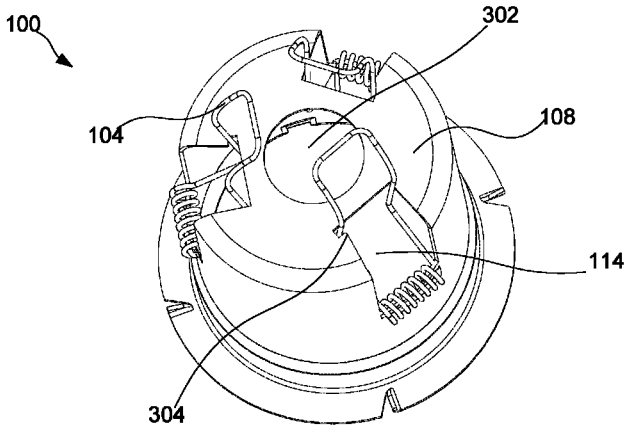
FIG. 3A is a top view of the panel component holder of FIG. 1 with the supporting means of FIG. 2B.

In one embodiment, the panel component holder 100 may have an opening adapted to receive a cable, for example an Ethernet cable, power lines, or signal lines. FIG. 3A, which is a top view of the panel component holder 100 with the supporting means of FIG. 2B, shows such an opening 302 arranged in the mid part of the second end 108.

The object of the retainer 304 is to retain the supporting means 104 while the elastic means 118 is strained. It is to be understood that the retainer 304 may be realized in many different ways. It may for example be a part of the casing 102 and be of different shape for example a slot, a protrusion, or the like. Furthermore, the panel component holder 100 may comprise one or more retainers 304 for every supporting means 104.

If the retainer is realized as a protrusion 304, the protrusion 304 may be arranged somewhere at the edge of the at least one control opening 114. The supporting means 104 is then detachably attached to the casing 102 by retracting the supporting means 104 and positioning the supporting means 104 against to the protrusion and on the inside of the casing 102. This enables the protrusion 304 to retain the supporting means 104 and prevents the supporting means 104 from moving outwardly due to the strained elastic means 118.

In FIGS. 3A and B, the retainers 304 are realized as protrusions 304 and the supporting means 104 are detachably attached to the casing 102.

In another embodiment the casing wall 110 itself may serve as a retainer. In this embodiment, the supporting means 104 may comprise at least one protrusion protrudingly arranged on the supporting means 104 between the attached end 120 and the free end 122. In order to detachably attach the supporting means to the casing wall 110, the supporting means is guided through the control opening 114 and the at least one protrusion is positioned against the casing wall 110 and on the inside of the casing 102.

In a further embodiment, the retainer 304 may be arranged as a slot situated at the second end 108. This embodiment is particularly useful when the supporting means 104 is realized as a supporting plate comprising a protrusion protrudingly arranged at the free end 122 of the supporting plate. The supporting means 104 is detachably attached to the casing 102 by positioning the protrusion inside the casing 102, through the slot.

The brim 112 may have teeth 306 protruding in a direction towards the second end 108 arranged at a distance between each other. When inserting the panel component holder 100 through an opening in a panel element, the brim 112 abuts against the outer side of the panel element and the teeth 306 may engagingly attach to the outer side of the panel element. The teeth 306 help to prevent movement of the panel component holder 100 during attachment of panel components to the panel component holder 100.

The fashion of how the supporting means 104 is released from the retainer 304 depends on the realization of the supporting means 104 and of the retainer 304.

In one embodiment, the panel component holder 100 comprises at least two retainers 304 for every supporting means 104. In order to release the supporting means 104, the flexible section is, from the inside of the casing 102, gently compressed thus releasing the supporting means 104 from the retainers 304 and enabling the supporting means 104 to move outwardly from the casing 102. In this embodiment the supporting means 104 may for example be realized as at least two elongated members having a flexible section, as a flexible supporting plate, or as a supporting plate having a flexible section.

Figure 3B:
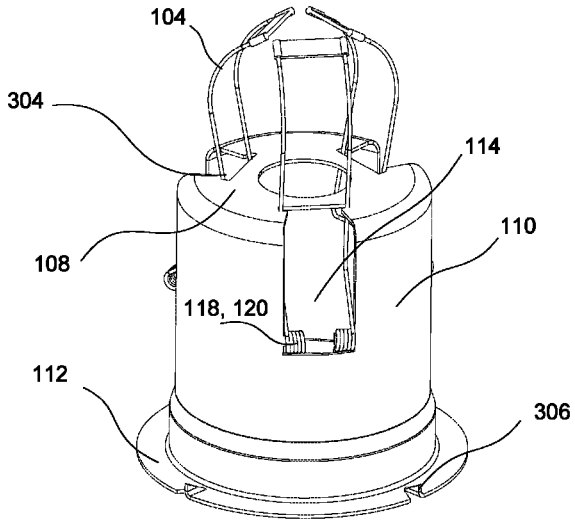
FIG. 3B is a side view of the panel component holder of FIG. 1.
Figure 4:
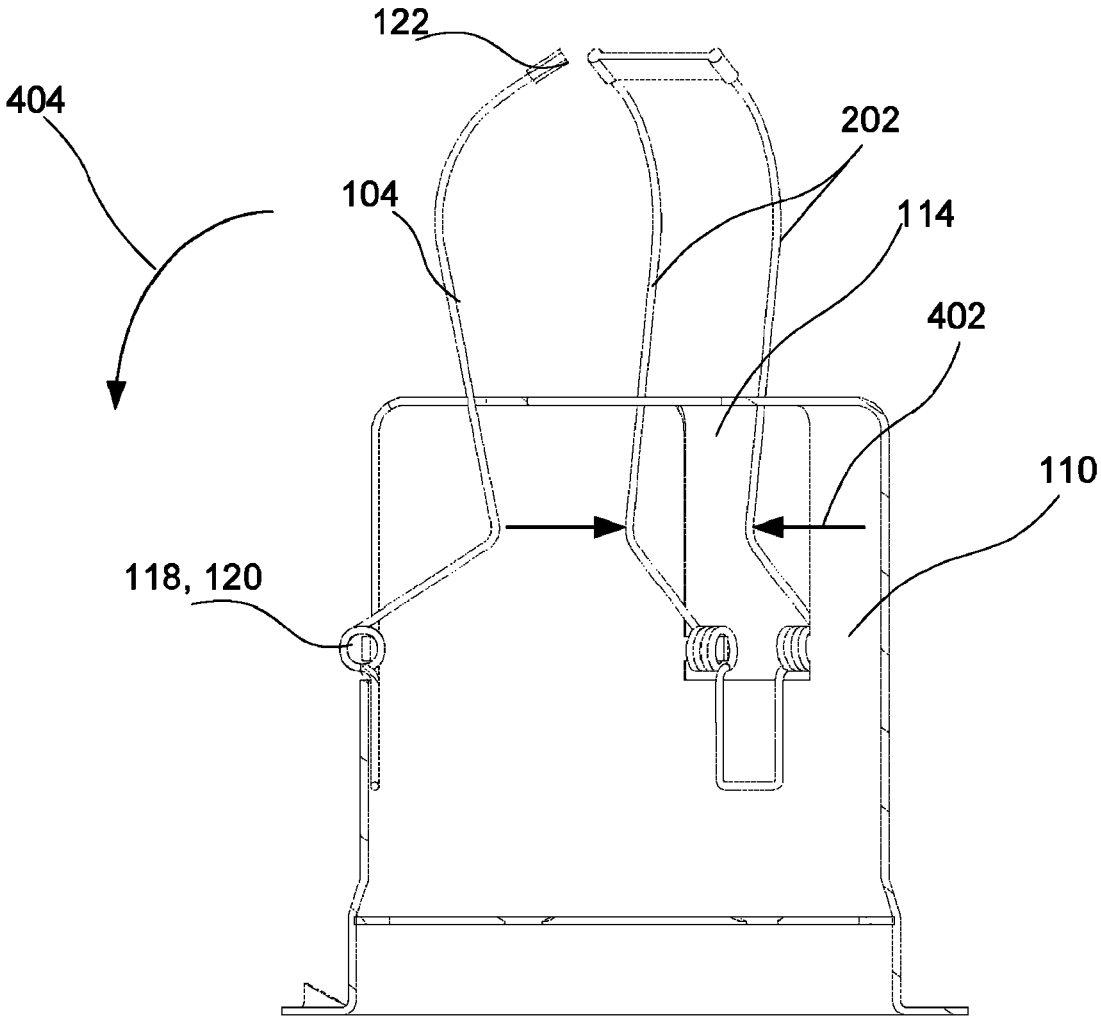
FIG. 4 is a side view of a cross section of the panel component holder of FIG. 1.

An embodiment having two retainers 304 for every supporting means 104 is shown in FIG. 4, which shows a cross section of the panel component holder of FIG. 3B. In the embodiment of FIG. 4, the supporting means 104 is released from the inside by gently squeezing the two elongated members 202 together, as illustrated by the arrows 402, and pushing the two elongated members 202 outwardly through the control opening 114 till they are out of reach for the retainers 304. When released, the supporting means 104 moves outwardly and downwardly as illustrated by the arrow 404. The motion is brought to a stop when the supporting means 104 abuts against the inner side of the panel element to which the panel component holder is to be mounted to.

In another embodiment, the panel component holder 100 comprises one retainer 304 for every supporting means 104. If the supporting means 104 is realized as for example at least two elongated members having a flexible section, as a flexible supporting plate, or as a supporting plate having a flexible section the supporting means 104 may be released from the retainer 304 in the same way as described for the embodiment having two retainers 304 for every supporting means 104. However, if the supporting means 104 is realized for example as at least one leg or as a supporting plate not having a flexible section, another means of releasing the supporting means 104 is applicable. It should though be noted that this way of releasing the supporting means 104 also applies to other embodiments of the supporting means 104 described in this application. The supporting means 104 is released by pushing the supporting means 104 in a direction from the retainer 304 towards the other side of the control opening 114, thus compressing the elastic means 118, in this case at least one torsion spring. By, after compressing the elastic means 118, moving the supporting means 104 outwardly through the control opening 114, the supporting means may be moved out of reach for the retainer 304. Then, after ceasing the compressing, the supporting means 104 describes an outwardly and downwardly motion, induced by the elastic means 118, till the supporting means 118 abuts against the inner side of the panel element to be mounted to.

Figure 5A:
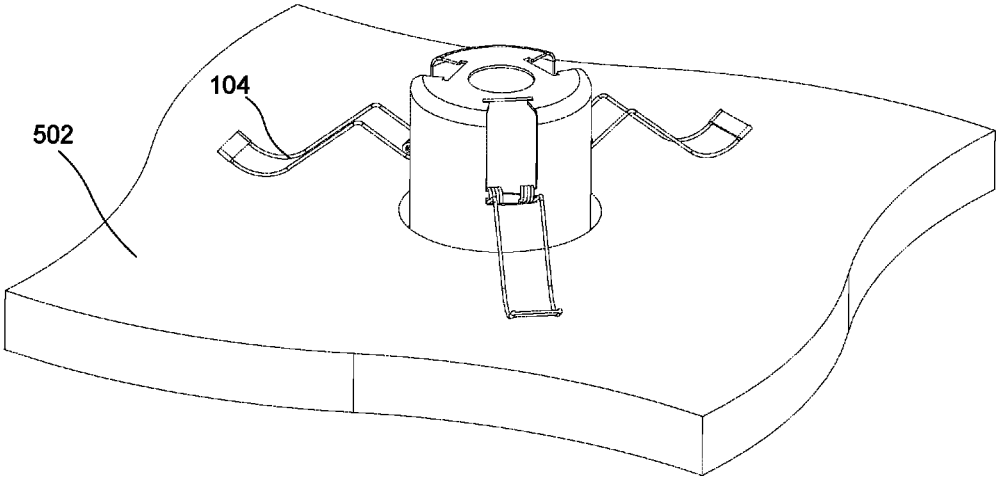
FIG. 5A is a perspective view of a panel element and the panel component holder of FIG. 1.
Figure 5B:
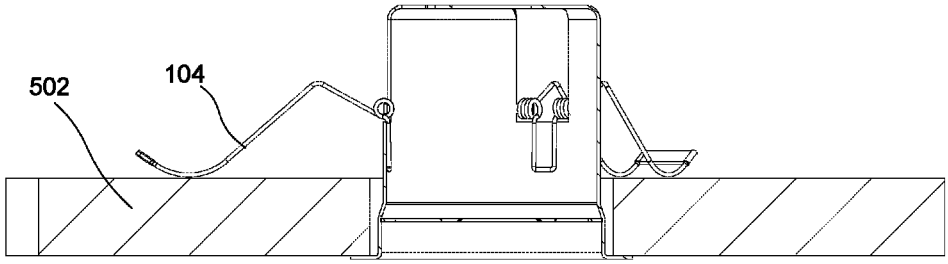
FIG. 5B is a side view of a cross section of the panel element and the panel component holder of FIG. 5A.

FIG. 5A shows the panel component holder 100 mounted to the panel element 502. FIG. 5B depicts a cross section of the panel component holder 104 and the panel element 502 of FIG. 5A.

Figure 6:
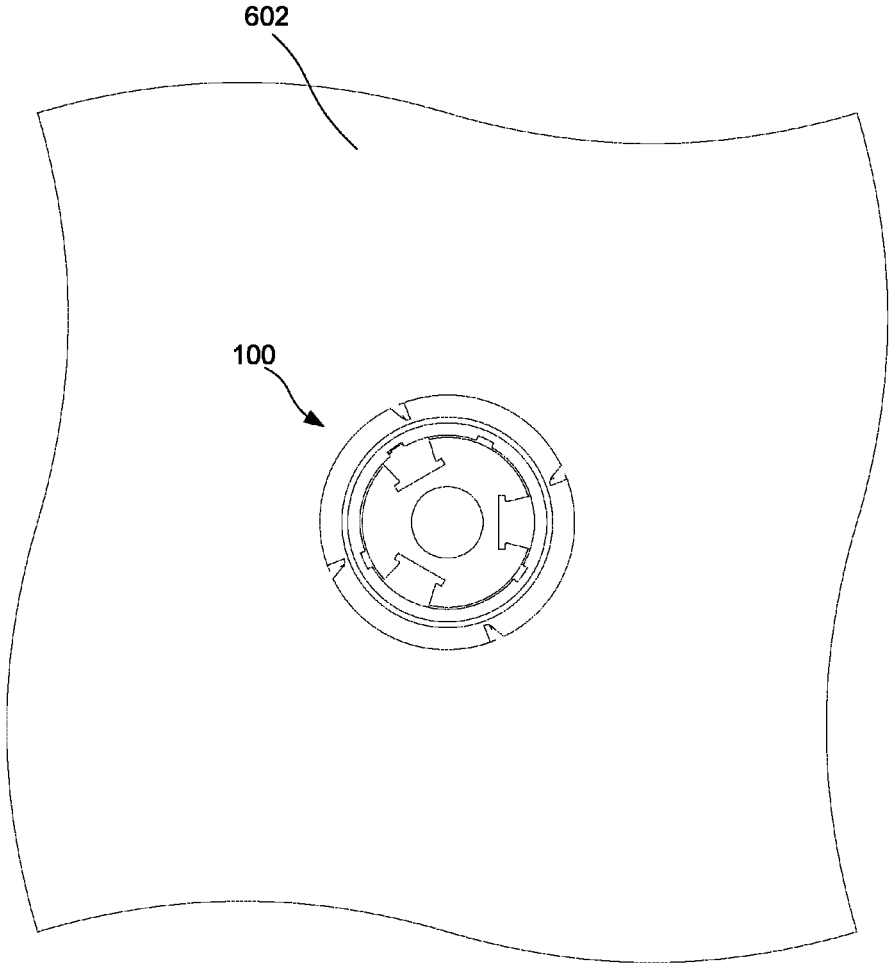
FIG. 6 is a bottom view of a panel element and the panel component holder of FIG. 1.

FIG. 6 shows a bottom view of the panel component holder 100 and the panel element 502 of FIG. 5A. It is clearly seen from the Figure that a panel component is easily mounted to the panel component holder 100, inside the casing 102.

When mounting a panel component holder 100 to a panel element, the panel component holder 100 is firstly put in a state suitable for mounting. This state includes straining the supporting means 104 and detachably attaching them to the retainers 304.

After that, the panel component holder 100 is inserted into an opening in the panel element till the brim 112 abuts against the outer side of the panel element.

After inserting the panel component holder 100 through the opening of the panel element, the supporting means 104 are released from the retainers 304 from the inside of the casing 102.

When released, the free ends 122 of the supporting means 104 move outwardly from the casing in a plane coinciding with the centre axis of the casing 102 down to abut against the inner side of the panel element. The outwardly movement of the supporting means 104 is induced by the now released but formerly strained elastic means 118.

After installation of the panel component holder 100, a panel component may be easily attached to the panel component holder 100.

What is claimed is:

1. A panel component holder arranged to be attached to a panel element, comprising:

a casing including a top wall, and a side wall having a brim formed at an open end of the casing, wherein the casing side wall comprises at least one control opening for enabling control of the supporting means, the at least one control opening being partly arranged in the casing side wall and partly in the top wall;

at least one retainer on the casing; and at least one supporting means comprising at least one leg with a free end and an attached end, the attached end being attached to the casing, the at least one supporting means further comprising an elastic means;

wherein in a first panel component holder state suitable for inserting the panel component holder through a panel element opening, said at least one retainer and the at least one leg are coupled such that the at least one supporting means is configured in a substantially upright position with only the elastic means partially protruding the side wall of the casing, thereby to prevent downward and outward movement of the at least one supporting means from said casing in a plane coinciding with a centre axis of the casing, wherein downward is in a direction towards the open end of the casing and away from the top wall of the casing, the open end of the casing used for insertion of a panel component, wherein the downward and outward movement of the supporting means is induced by the elastic means, wherein the at least one supporting means is arranged to be released from the at least one retainer from within the casing to transfer the panel component holder from said first panel component holder state to a second panel component holder state, and wherein the free end, in the second panel component holder state, is arranged to abut against an inner side of the panel element with the brim of the casing abutted against an outer side of the panel element.

2. The panel component holder according to claim 1, wherein the elastic means is a torsion spring.

3. The panel component holder according to claim 1, wherein the elastic means is arranged at the attached end.

4. The panel component holder according to claim 1, wherein the at least one supporting means further comprises a flexible section arranged between the attached end and the free end.

5. The panel component holder according to claim 1, wherein the at least one supporting means further comprises at least one bend arranged between the attached end and the free end.

6. The panel component holder according to claim 1, wherein the at least one retainer is formed by an edge of the at least one control opening.

7. The panel component holder according to claim 6, wherein the at least one retainer is formed as a protrusion.

8. The panel component holder according to claim 1, wherein an opening is arranged substantially centrally in the top wall.

9. A method for attaching a panel component holder to a panel element, wherein the panel component holder comprises a casing including a top wall, and a side wall having a brim formed at an open end of the casing and at least one retainer on the casing, wherein the casing side wall comprises at least one control opening for enabling control of the supporting means, the at least one control opening being partly arranged in the casing side wall and partly in the top wall; and at least one supporting means comprising an attached end being attached to the casing, the at least one supporting means further comprising an elastic means and a free end; the method comprising:

coupling the at least one retainer to at least one leg of at least one supporting means such that the at least one supporting means is configured in a substantially upright position with only the elastic means partially protruding the side wall of the casing, thereby to prevent downward and outward movement of the at least one supporting means from said casing in a plane coinciding with a centre axis of the casing to place the panel component holder in a first panel component holder state, wherein downward is in a direction towards the open end of the casing and away from the top wall of the casing, the open end of the casing used for insertion of a panel component;

inserting the panel component holder through an opening in the panel element while in the first panel component holder state;

abutting the brim against an outer side of the panel element; and releasing said at least one supporting means from the at least one retainer from within said casing to transfer the panel component holder from said first panel component holder state to a second panel component holder state, wherein the free end, in the second panel component holder state, is arranged to abut against an inner side of the panel element, and wherein the downward and outward movement of the supporting means is induced by the elastic means.

10. The method according to claim 9, wherein the releasing of said supporting means further comprises moving a portion of the at least one supporting means out of reach for the at least one retainer.

11. The panel component holder according to claim 1, wherein the transfer from the first panel component holder state to the second panel component holder state occurs in a motion that is brought to a stop when the free end of the supporting means abuts against the inner side of the panel.

12. The method according to claim 9, wherein the transfer from the first panel component holder state to the second panel component holder state occurs in a motion that is brought to a stop when the free end of the supporting means abuts against the inner side of the panel.

13. The panel component holder according to claim 1, wherein the free end of the at least one supporting means is configured in a position above the top wall of the casing when in the first panel component holder state to provide clearance between the entire supporting means and the panel element while inserting the panel component holder through the panel element opening.

14. The method of claim 9, wherein the coupling of the retainer to the at least one leg includes maintaining the free end of the at least one supporting means in a position above the second end of the casing when in the first panel component holder state to provide clearance between the entire supporting means and the panel element while inserting the panel component holder through the panel element opening.

* * * * *